US008696831B2

(12) United States Patent
Shan et al.

(10) Patent No.: US 8,696,831 B2
(45) Date of Patent: Apr. 15, 2014

(54) CHROMATE-FREE CONVERSION FILM SOLUTION AND THE METHOD OF APPLYING THE SOLUTION TO MAGNESIUM ALLOYS

(75) Inventors: Dayong Shan, Shenyang (CN); Yingwei Song, Shenyang (CN); Enhou Han, Shenyang (CN); Rongshi Chen, Shenyang (CN); Wei Ke, Shenyang (CN)

(73) Assignee: Institute of Metal Research Chinese Academy of Sciences, Shenyang (CN)

( * ) Notice: Subject to any disclaimer, the term of this patent is extended or adjusted under 35 U.S.C. 154(b) by 510 days.

(21) Appl. No.: 12/832,163

(22) Filed: Jul. 8, 2010

(65) Prior Publication Data

US 2011/0226388 A1 Sep. 22, 2011

(30) Foreign Application Priority Data

Mar. 17, 2010 (CN) ..... 2010 1 0125808

(51) Int. Cl.
*C23C 22/48* (2006.01)
*C23C 22/18* (2006.01)
*C23C 22/07* (2006.01)

(52) U.S. Cl.
USPC ..... 148/247; 148/253; 148/262; 148/275; 106/14.12

(58) Field of Classification Search
CPC ..... C23C 22/06; C23C 22/07; C23C 22/18; C23C 22/40; C23C 22/42; C23C 22/48; C23C 22/57
USPC ..... 148/247, 253–263, 275; 106/14.12
See application file for complete search history.

(56) References Cited

U.S. PATENT DOCUMENTS

| | | | | |
|---|---|---|---|---|
| 5,904,784 | A * | 5/1999 | Iino et al. | 148/247 |
| 6,887,320 | B2 | 5/2005 | Briles | |
| 7,819,989 | B2 * | 10/2010 | Ishikura et al. | 148/273 |
| 2003/0230364 | A1 * | 12/2003 | Greene et al. | 148/256 |
| 2007/0017602 | A1 * | 1/2007 | Koch et al. | 148/247 |

OTHER PUBLICATIONS

Han et al. (2003) "Corrosion and Protection of Magnesium Alloy AZ31D by a New Conversion Coating" Materials Science Forum 419-422:879-882.

Liu et al. (2008) "Barium Phosphate Conversion Coating on Die-Cast AZ91D Magnesium Alloy" Trans. Nonferrous Met. Soc. China 18:s344-s348.

Zhou et al. (2005) "Phosphate Conversion Coating on Diecast AZ91D and Its Corrosion Resistance" Materials Science Forum 488-489:819-822.

Zhou et al. (2008) "Structure and Formation Mechanism of Phosphate Conversion Coating on Die-Cast AZ91D Magnesium Alloy" Corrosion Science 50:329-337.

* cited by examiner

*Primary Examiner* — Lois Zheng

(74) *Attorney, Agent, or Firm* — Smith, Gambrell & Russell, LLP

(57) ABSTRACT

Disclosed herein is a chromate-free conversion film solution and a method of applying the solution to magnesium and magnesium alloys. The solution contains zirconium ions, manganese ions, barium ions and phosphate corrosion inhibitor; and the pH of the said solution is in the range of 1-5; and may further comprise molybdate as accelerant. The method comprises degreasing, acid etching, surface activation, surface adjusting, and film forming steps. The conversion film obtained in accordance with the disclosed method is uniform, smooth, and compact and has high corrosion resistance and good adhesion with paint film. Moreover, the chromate-free conversion film solution is environmentally friendly and possesses fast film growth rates.

2 Claims, No Drawings

CHROMATE-FREE CONVERSION FILM SOLUTION AND THE METHOD OF APPLYING THE SOLUTION TO MAGNESIUM ALLOYS

FIELD OF THE INVENTION

The present invention relates to a chromate-free conversion film solution and the method of applying the said solution to magnesium or magnesium alloys.

BACKGROUND OF THE INVENTION

Magnesium and its alloys, as the lightest structural materials, are widely applied to the fields of electronics, aerospace and automobile due to their desirable properties including high specific strength and specific stiffness, excellent conductivity of electricity and heat, easy to cut and recycle, and good damping characteristic. However, magnesium is a very active metal. Magnesium alloys parts need to be protected from corroding in the practical applications. A low cost and corrosion resistant treatment for magnesium alloys is chromate conversion film. Although chromate conversion film can provide good corrosion protection to magnesium alloys, the toxic hexavalent chromium ions have a bad effect on the environment. Thus, a chromate-free and high corrosion resistance conversion film is required to meet the urgent demands for magnesium alloys.

SUMMARY OF THE INVENTION

In view of the shortage of the prior arts, the object of the present invention is to provide an environmentally friendly solution which can achieve a high corrosion resistance conversion film on magnesium or magnesium alloys. The other object of the present invention is to provide a method to prepare the conversion film.

In order to accomplish the above objects, the present invention provides a solution for forming chromate-free conversion film on magnesium or magnesium alloys; wherein the solution comprises zirconium ions, manganese ions, barium ions and phosphate corrosion inhibitor; the solution having a pH of 1 to 5 contains 0.01-2 g/l zirconium ions, 2-14 g/l manganese ions, 0.01-8 g/l barium ions and 8-30 g/l phosphate corrosion inhibitor. The source of the zirconium ions in the solution is selected from the group consisting of potassium fluozirconate, zirconium nitrate, zirconium acetyl acetonate, zirconium fluoride, zirconium sulfate, or mixtures thereof. The source of the manganese ions in the solution is selected from the group consisting of manganese nitrate, manganese dihydrogen phosphate, manganese sulfate, or mixtures thereof. The source of the barium ions in the solution is selected from the group consisting of barium acetate, barium nitrate, or mixtures thereof. The source of the phosphate corrosion inhibitor in the solution is one or more compounds selected from the group consisting of sodium dihydrogen phosphate, potassium dihydrogen phosphate, ammonium dihydrogen phosphate, ammonium phosphate, sodium phosphate, potassium phosphate, or other phosphates. Preferably the solution further comprises 0.2-3 g/l molybdate as accelerant which is selected from the group consisting of sodium molybdate, potassium molybdate, ammonium molybdate, or mixtures thereof.

A method of applying the solution to form conversion film on magnesium or magnesium alloys, comprising the steps of:

1) degreasing: removing the greasy dirt from the surface of magnesium substrate in an alkaline solution;

2) acid etching: removing the oxides film and impurities from the surface of magnesium substrate in 0.2-2 wt % organic acids solution selected from the group consisting of citric acid, succinic acid, lactic acid, acetic acid, or mixtures thereof; maintaining the acid etching solution at a temperature of 20-50° C. and immersing the magnesium substrate into the organic acids solution for a period of 0.5-5 min;

3) activating: activating the magnesium substrate in an active solution containing 2-15 wt % acidic fluorides selected from the group consisting of ammonium acid fluoride, fluosilicic acid, or mixtures thereof; maintaining the active solution at a temperature of 20-60° C. and immersing the magnesium substrate into the active solution for a period of 2-20 min;

4) surface adjusting: adjusting the surface of magnesium substrate in a surface adjusting solution containing 0.1-3 wt % titanium phosphate; maintaining the surface adjusting solution at a temperature of 20-50° C. and immersing the magnesium substrate into the surface adjusting solution for a period of 0.5-10 min;

5) forming film: immersing the pretreated magnesium substrate into the chromate-free conversion film solution to form a conversion film; maintaining the solution at a temperature of 30-90° C. and immersing the magnesium substrate into the solution for a period of 5-60 min; the pH of the solution is in the range of 1-5.

The magnesium substrate refers to magnesium or magnesium alloys.

Water rinsing is required after the above steps.

The present invention has the following advantages:

1. The environmentally harmfully chromate is not used in the present invention, which can reduce the pollution to the environment.

2. In the chromate-free conversion film solution, the barium ions can make the conversion film more smooth and compact; zirconium ions are helpful for improving the adhesion between the conversion film and the subsequent organic coatings; the molybdate as accelerant can promote the growth rate of the film and reduce the film formation time.

3. Organic acids are used in the etching process, which can uniformly etch the magnesium substrate and avoid the formation of component segregation on the surface of magnesium substrate.

4. The surface adjusting treatment in the pretreatment process can increase the nucleating centers on the surface of magnesium substrate, which is available for improving the compactness of the conversion film.

5. The conversion film is high corrosion resistance and good adhesion with organic coatings.

These and other objectives, features, and advantages of the present invention will become apparent from the following detailed description and the appended claims.

DETAILED DESCRIPTION OF THE INVENTION

The present invention provides a chromate-free conversion film solution which comprises zirconium ions, manganese ions, barium ions and phosphate corrosion inhibitor; the preferred pH of the solution is in the range of 1-5.

The chromate-free conversion film solution comprises 0.01-2 g/l zirconium ions, 2-14 g/l manganese ions, 0.01-8 g/l barium ions and 8-30 g/l phosphate corrosion inhibitor. The preparation process of the solution comprises the steps of: weigh out the chemicals containing the above ions in the calculated quantity, dissolve these chemicals respectively using water, mix all the dissolved chemicals in a vessel, and then dilute the mixed solution to the required concentration; the water with a preferred distilled water.

The source of zirconium ions is selected from the group consisting of potassium fluozirconate, zirconium nitrate, zirconium acetyl acetonate, zirconium fluoride, zirconium sulfate, or mixtures thereof; the source of manganese ions is selected from the group consisting of manganese nitrate, manganese dihydrogen phosphate, manganese sulfate, or mixtures thereof; the source of barium ions is selected from the group consisting of barium acetate, barium nitrate, or mixtures thereof; the source of phosphate corrosion inhibitor is one or more compounds selected from the group consisting of sodium dihydrogen phosphate, potassium dihydrogen phosphate, ammonium dihydrogen phosphate, ammonium phosphate, sodium phosphate, potassium phosphate, and other phosphates.

Preferably, the solution further comprises the molybdate as accelerant. The molybdate is selected from the group consisting of sodium molybdate, potassium molybdate, ammonium molybdate, or mixtures thereof; and the preferred concentration of the molybdate is in the range of 0.2-3 g/l; the molybdate can promote the growth rate of the film and shorten the film formation time.

The pH of the chromate-free conversion film solution is adjusted with acid solutions selected from the group consisting of nitric acid, phosphoric acid, sulfuric acid, or mixtures thereof. The concentration of nitric acid, phosphoric acid and sulfuric acid is 69 wt %, 85 wt % and 98 wt %, respectively, and dilute them to the required concentration with distilled water for use.

The method of applying the solution to form conversion film on magnesium or magnesium alloys comprises the steps of:

1) Degreasing the substrate; degreasing can remove the greasy dirt from the surface of magnesium substrate. Degreasing solution comprises alkaline ingredients selected from the group consisting of sodium hydroxide, potassium hydroxide, sodium silicate, sodium carbonate, sodium phosphate, or mixtures thereof dissolved in water; wherein the water with a preferred distilled water. The preferred concentration of sodium hydroxide is in the range of 5-120 g/l, potassium hydroxide is in the range of 5-35 g/l, sodium silicate is in the range of 10-25 g/l, sodium carbonate is in the range of 10-30 g/l, sodium phosphate is in the range of 10-50 g/l; maintaining the degreasing solution at a temperature of 50-90° C., with a preferred temperature of 55-80° C. The degreasing time is associated with the contamination degree of the magnesium substrate's surface. If the surface of the magnesium substrate is covered with abundant greasy dirt, longer degreasing time is required. The preferred degreasing time is 5-30 min.

2) Acid etching the substrate; acid etching can remove oxides film and impurities from the surface of magnesium substrate. The acid etching solution comprises organic acids being one or more acid solutions selected from the group consisting of citric acid, succinic acid, lactic acid, acetic acid, or mixtures thereof dissolved in water; wherein the water with a preferred distilled water. The preferred concentration of the organic acids is in the range of 0.2-2 wt %; immersing the magnesium substrate into the acid etching solution at a temperature of 20-50° C. for a period of 0.5-5 min to clean the oxides film and impurities, generally at room temperature. The acid etching time should be controlled strictly. If the time is more than 5 min, the surface of the magnesium substrate will be severely corroded, which will affect the quality of the conversion film. In comparison with inorganic acids etching solution, the organic acids can uniformly etch the magnesium substrate and avoid the formation of component segregation on the surface of magnesium substrate. Moreover, the products formed on the surface of magnesium substrate during organic acids etching is easy to be removed by the following activating treatment.

3) Activating the substrate; activating can further remove the residues on the surface of magnesium substrate and obtain a uniform surface for growing conversion film. The activating solution comprises acidic fluorides selected from the group consisting of fluosilicic acid, ammonium acid fluoride, or mixtures thereof dissolved in water at a concentration of 2-15 wt %, with a preferred concentration of 5-10 wt %; wherein the water with a preferred distilled water. Immersing the magnesium substrate into the activating solution at a temperature of 20-60° C. for a period of 2-20 min, generally at room temperature; wherein the preferred activating time should be determined in terms of the surface condition of the magnesium substrate and the concentration of the activating solution.

4) Surface adjusting the substrate; the method of the present invention further contains a step of surface adjusting. The surface adjusting solution comprises titanium phosphate dissolved in water; wherein the water with a preferred distilled water. The concentration of the titanium phosphate is 0.1-3 wt %; maintaining the temperature of the surface adjusting solution at 20-50° C., generally at room temperature; immersing the magnesium substrate into the surface adjusting solution for a period of 0.5-10 min. Titanium phosphate exists in a state of colloid in the aqueous solution. After the magnesium substrate being immersed in the surface adjusting solution, titanium phosphate colloids can absorb on the surface of magnesium substrate and then convert into titanium phosphate crystal nucleuses. The existence of the titanium phosphate crystal nucleuses is available to increase the nucleating centers and improve the compactness and corrosion resistance of the conversion film.

Water rinsing is required after the above steps.

5) Forming film; immersing the magnesium substrate into the chromate-free conversion film solution to obtain a conversion film with a thickness of about 3 to about 12 μm. The average growth rate of the film can be calculated based on the following equation:

Average growth rate of the film=film thickness/film formation time.

It needs to maintain the temperature of the solution in the range of 30-90° C., with a preferred temperature of 40-80° C. The film formation time is 5-60 min, and the preferred time can be determined according to the quality of the conversion film. The pH of the solution will change during the process of forming film. Thus, it is required to measure and adjust the pH of the solution regularly. Adjusting the pH of the solution with nitric acid, phosphoric acid, sulfuric acid or mixtures thereof, the pH is maintained in the range of 1-5.

EXAMPLE 1

A chromate-free conversion film solution is prepared by dissolving the following ingredients in water: zirconium nitrate 3.7 g/l, manganese nitrate 26 g/l, barium nitrate 3.8 g/l, sodium dihydrogen phosphate 25.3 g/l and sodium molybdate 1.3 g/l. The obtained solution contains zirconium ions 1 g/l, manganese ions 8 g/l, barium ions 2 g/l, phosphate ions 20 g/l, molybdate ions 1 g/l, and the pH is adjusted to 3 using 10 wt % nitric acid.

The die cast AM60 magnesium alloys parts are treated in light of the following steps:

1. Degreasing: immersing the magnesium alloys parts into the alkaline solution consisting of sodium hydroxide 60 g/l, sodium phosphate 30 g/l and sodium carbonate 10 g/l at a temperature of 70° C. for 10 min to remove the greasy dirt; water rinsing;

2. Acid etching: immersing the magnesium alloys parts into 1.0 wt % citric acid solution at room temperature for 1 min to remove the oxides film, rusts, corrosion products and other filths; water rinsing;

3. Activating: immersing the magnesium alloys parts into 5.0 wt % ammonium acid fluoride solution at room temperature for 5 min to further remove the residues and obtain a uniform surface for growing conversion film; water rinsing;

4. Surface adjusting: immersing the magnesium alloys parts into 0.5 wt % titanium phosphate solution at room temperature for 3 min to form abundant titanium phosphate crystal nucleuses on the surface of magnesium alloys; water rinsing;

5. Forming film: immersing the pretreated magnesium alloys parts into the chromate-free conversion film solution at a temperature of 50° C. for 15 min to form a gray conversion film with a thickness of 8 μm; water rinsing, then drying.

EXAMPLE 2

A chromate-free conversion film solution is prepared by dissolving the following ingredients in water: zirconium sulfate 0.8 g/l, manganese sulfate 38.4 g/l, barium nitrate 0.95 g/l and ammonium phosphate 47 g/l. The obtained solution contains zirconium ions 0.2 g/l, manganese ions 14 g/l, barium ions 0.5 g/l, phosphate ions 30 g/l, and the pH is adjusted to 2 using 10 wt % sulfuric acid.

The extrusion AZ31 magnesium alloys parts are treated in light of the following steps:

1. Degreasing: immersing the magnesium alloys parts into the alkaline solution consisting of potassium hydroxide 10 g/l, sodium phosphate 50 g/l and sodium silicate 15 g/l at a temperature of 80° C. for 5 min to remove the greasy dirt; water rinsing;

2. Acid etching: immersing the magnesium alloys parts into 0.2 wt % lactic acid solution at room temperature for 5 min to remove the oxides film, rusts, corrosion products and other filths; water rinsing;

3. Activating: immersing the magnesium alloys parts into 8 wt % fluosilicic acid solution at a temperature of 50° C. for 2 min to further remove the residues and obtain a uniform surface for growing conversion film; water rinsing;

4. Surface adjusting: immersing the magnesium alloys parts into 2.5 wt % titanium phosphate solution at a temperature of 30° C. for 4 min to form abundant titanium phosphate crystal nucleuses; water rinsing;

5. Forming film: immersing the pretreated magnesium alloys parts into the chromate-free conversion film solution at a temperature of 70° C. for 30 min to form a grayish conversion film with a thickness of 7 μm; water rinsing, then drying.

EXAMPLE 3

A chromate-free conversion film solution is prepared by dissolving the following ingredients in water: potassium fluozirconate 1.5 g/l, manganese dihydrogen phosphate 27.2 g/l, barium acetate 0.2 g/l and ammonium dihydrogen phosphate 9.7 g/l. The obtained solution contains zirconium ions 0.5 g/l, manganese ions 6 g/l, barium ions 0.1 g/l, phosphate ions 8 g/l, and the pH is adjusted to 1.5 using 10 wt % nitric acid.

The die cast AZ91D magnesium alloys parts are treated in light of the following steps:

1. Degreasing: immersing the magnesium alloys parts into the alkaline solution consisting of sodium carbonate 80 g/l and sodium phosphate 15 g/l at a temperature of 50° C. for 20 min to remove the greasy dirt; water rinsing;

2. Acid etching: immersing the magnesium alloys parts into the solution consisting of 0.5 wt % citric acid and 1.5 wt % succinic acid at a temperature of 40° C. for 0.5 min to remove the oxides film, rusts, corrosion products and other filths; water rinsing;

3. Activating: immersing the magnesium alloys parts into 13 wt % ammonium acid fluoride solution at a temperature of 25° C. for 10 min to further remove the residues and obtain a uniform surface for growing conversion film; water rinsing;

4. Surface adjusting: immersing the magnesium alloys parts into 0.1 wt % titanium phosphate solution at room temperature for 10 min to form abundant titanium phosphate crystal nucleuses on the surface of magnesium alloys; water rinsing;

5. Forming film: immersing the pretreated magnesium alloys parts into the chromate-free conversion film solution at a temperature of 40° C. for 50 min to form a dark gray conversion film with a thickness of 12 μm; water rinsing, then drying.

EXAMPLE 4

A chromate-free conversion film solution is prepared by dissolving the following ingredients in water: zirconium fluoride 0.02 g/l, manganese sulfate 5.5 g/l, barium nitrate 15.2 g/l, potassium dihydrogen phosphate 21.5 g/l and potassium molybdate 0.3 g/l. The obtained solution contains zirconium ions 0.01 g/l, manganese ions 2 g/l, barium ions 8 g/l, phosphate ions 15 g/l, molybdate ions 0.2 g/l, and the pH is adjusted to 4 using 10 wt % sulfuric acid.

The extrusion AM30 magnesium alloys parts are treated in light of the following steps:

1. Degreasing: immersing the magnesium alloys parts into the alkaline solution consisting of sodium hydroxide 120 g/l at a temperature of 50° C. for 30 min to remove the greasy dirt; water rinsing;

2. Acid etching: immersing the magnesium alloys parts into 0.8 wt % acetic acid solution at room temperature for 3 min to remove the oxides film, rusts, corrosion products and other filths; water rinsing;

3. Activating: immersing the magnesium alloys parts into 2 wt % fluosilicic acid solution at a temperature of 40° C. for 15 min to further remove the residues and obtain a uniform surface for growing conversion film; water rinsing;

4. Surface adjusting: immersing the magnesium alloys parts into 1 wt % titanium phosphate solution at a temperature of 50° C. for 1 min to form abundant titanium phosphate crystal nucleuses on the surface of magnesium alloys; water rinsing;

5. Forming film: immersing the treated magnesium alloys parts into the said chromate-free conversion film solution at a temperature of 80° C. for 5 min to form a grayish conversion film with a thickness of 5 μm; water rinsing, then drying.

EXAMPLE 5

A chromate-free conversion film solution is prepared by dissolving the following ingredients in water: zirconium nitrate 5.6 g/l, manganese nitrate 32.5 g/l, barium acetic 0.02 g/l, sodium phosphate 34.5 g/l and sodium molybdate 3.9 g/l. The obtained solution contains zirconium ions 1.5 g/l, manganese ions 10 g/l, barium ions 0.01 g/l, phosphate ions 20 g/l, molybdate ions 3 g/l, and the pH is adjusted to 5 using 10 wt % nitric acid.

The die cast AZ91D magnesium alloys parts are treated in light of the following steps:

1. Degreasing: immersing the magnesium alloys parts into the alkaline solution consisting of sodium hydroxide 70 g/l and sodium carbonate 20 g/l at a temperature of 90° C. for 15 min to remove the greasy dirt; water rinsing;

2. Acid etching: immersing the magnesium alloys parts into the solution consisting of 2 wt % citric acid and 2 wt % succinic acid at a temperature of 30° C. for 0.5 min to remove the oxides film, rusts, corrosion products and other filths; water rinsing;

3. Activating: immersing the magnesium alloys parts into 15 wt % ammonium acid fluoride solution at a temperature of 60° C. for 10 min to further remove the residues and obtain a uniform surface for growing conversion film; water rinsing;

4. Surface adjusting: immersing the magnesium alloys parts into 3 wt % titanium phosphate solution at a temperature of 40° C. for 0.5 min to form abundant titanium phosphate crystal nucleuses on the surface of magnesium alloys; water rinsing;

5. Forming film: immersing the pretreated magnesium alloys parts into the chromate-free conversion film solution at a temperature of 85° C. for 20 min to form a gray conversion film with a thickness of 10 μm; water rinsing, then drying.

COMPARATIVE EXAMPLE 1

A chromate-free conversion film solution is prepared by dissolving the following ingredients in water: manganese nitrate 15 g/l, barium nitrate 25 g/l and ammonium dihydrogen phosphate 20 g/l. The obtained solution contains manganese ions 4.6 g/l, barium ions 13.1 g/l, phosphate ions 16.5 g/l, and the pH is adjusted to 2.6 using 10 wt % phosphoric acid.

The die cast AZ91D magnesium alloys parts are treated in light of the following steps:

1. Degreasing: immersing the magnesium alloys parts into the alkaline solution consisting of sodium hydroxide 25 g/l at a temperature of 70° C. for 10 min to remove the greasy dirt; water rinsing;

2. Acid etching: immersing the magnesium alloys parts into 2 wt % ammonium dihydrogen phosphate solution at room temperature for 2 min to remove the oxides film, rusts, corrosion products and other filths; water rinsing;

3. Forming film: immersing the pretreated magnesium alloys parts into the chromate-free conversion film solution at a temperature of 60° C. for 25 min to form a gray conversion film with a thickness of 6 μm; water rinsing, then drying.

COMPARATIVE EXAMPLE 2

A chromate-free conversion film solution is prepared by dissolving the following ingredients in water: manganese sulfate 27.5 g/l and ammonium dihydrogen phosphate 30.3 g/l. The obtained solution contains manganese ions 10 g/l, phosphate ions 25 g/l, and the pH is adjusted to 3 using 10 wt % phosphoric acid.

The die cast AZ91D magnesium alloys parts are treated in light of the following steps:

1. Degreasing: immersing the magnesium alloys parts into the alkaline solution consisting of sodium hydroxide 30 g/l and sodium phosphate 20 g/l at a temperature of 65° C. for 8 min to remove the greasy dirt; water rinsing;

2. Acid etching: immersing the magnesium alloys parts into 30 wt % phosphoric acid solution at a temperature of 30° C. for 1 min to remove the oxides film, rusts, corrosion products and other filths; water rinsing;

3. Activating: immersing the magnesium alloys parts into 5 wt % ammonium acid fluoride solution at room temperature for 5 min to further remove the residues and obtain a uniform surface for growing conversion film; water rinsing;

4. Forming film: immersing the pretreated magnesium alloys parts into the chromate-free conversion film solution at a temperature of 75° C. for 35 min to form a dark gray conversion film with a thickness of 10 μm; water rinsing, then drying.

EXPERIMENTAL EXAMPLE 1

Corrosion Resistance Measurement

According to the ASTM standard of full immersion testing, the conversion films obtained from Example 1-5 and Comparative Example 1-2 were fully immersed into the corrosive medium to evaluate the corrosion resistance. The corrosive medium was 3.5 wt % NaCl solution with a pH of 7. The ratio of the corrosive medium volume to the sample surface area was set to 20 ml/lcm$^2$, and the temperature of the corrosive medium was 25° C. The corrosion products were cleaned by immersing the corroded samples into a chromic acid bath consisting of $CrO_3$ 200 g/l and $AgNO_3$ 10 g/l at a temperature of 20-25° C. for 1 min. The samples before and after corrosion were weighed using an electronic balance. The average corrosion rate was calculated in light of the change of the sample's mass before and after immersion. Average corrosion rate was evaluated in terms of the following equation:

$$\text{Average corrosion rate}=m_1-m_2/\rho At;$$

$m_1$: the mass of the sample before immersion;
$m_2$: the mass of the sample after immersion;
ρ: the density of the sample;
A: the area of the sample;
t: immersion time.

The results are listed in Table 1.

EXPERIMENTAL EXAMPLE 2

Observation of Corrosion Morphology

The corrosion status of the samples 48 h later after full immersion testing was observed with eye. The results are listed in Table 1.

EXPERIMENTAL EXAMPLE 3

Adhesion Testing

The surface of the conversion films obtained from Example 1-5 and Comparative Example 1-2 was coated by the epoxy resin paint, forming a paint film with a thickness of approximate 40 μm. The adhesion testing was carried out after the paint film drying. The adhesion between the conversion film and the paint film was measured using cross cut test. 100 small panes with the dimension of 1 mm×1 mm were scored on the paint film using cross cut tester (hundred panes knife), and the depth of the scratch will ensure the exposure of magnesium substrate. 3M 600 adhesive tape was pasted onto the scored regions, and then pressed the adhesive tape to ensure the tight adhesion between the adhesive tape and the paint film. The adhesive tape was taken off from one side after 5 min. The quantities of the small panes falling off from the surface of the film were recorded as n. The adhesion was evaluated in terms of the following equation:

$$\text{Adhesion(percentage)}=(100-n)\%.$$

The properties of the conversion films obtained from Example 1-5 and Comparative Examples 1-2 were tested and evaluated according to the methods above. The results are listed in Table 1.

TABLE 1

| | Average corrosion rate (mm/a) | Adhesion %) | Film growth rate mm/min | Corrosion status 48 h later after full immersion testing |
|---|---|---|---|---|
| Example 1 | 0.48 | 99 | 0.53 | The color of the conversion film became darker, but the film was undamaged. There were 3 small white oxide particles observed on the surface of the film. |
| Example 2 | 0.55 | 99 | 0.23 | The color of the conversion film became darker, but the film was undamaged. There were 7 small white oxide particles observed on the surface of the film. |
| Example 3 | 0.53 | 98 | 0.24 | The color of the conversion film became darker, but the film was undamaged. There were 5 small white oxide particles observed on the surface of the film. |
| Example 4 | 0.64 | 99 | 1 | The color of the conversion film became darker, but the film was undamaged. There were more than ten small white oxide particles observed on the surface of the film. |
| Example 5 | 0.52 | 98 | 0.5 | The color of the conversion film became darker, but the film was undamaged. There were 5 small white oxide particles observed on the surface of the film. |
| Comparative Example 1 | 0.96 | 95 | 0.24 | There was not great change in the color of the conversion film. The film surface was not observed with obvious corrosion pits, but it was visible with plenty of small white oxide particles. |
| Comparative Example 2 | 1.2 | 98 | 0.29 | The color of the conversion film changed from gray to brown, and many black corrosion pits were visible on the surface of the film. |

It can be found from Table 1 that the conversion film obtained from the present invention is high corrosion resistance, good adhesion with paint film and fast film growth rate.

What is claimed is:

1. A solution for forming a chromate-free conversion film on magnesium and magnesium alloys which comprises zirconium ions, manganese ions, barium ions and phosphate corrosion inhibitor and a pH of 1 to 5, wherein said solution comprises, consists essentially of, or consists of 0.01-1 g/l zirconium ions, 2-14 g/l of manganese ions, 0.01-8 g/l barium ions and 8-30 g/l phosphate corrosion inhibitor, wherein said zirconium ions in the solution are from a source selected from the group consisting of zirconium nitrate, zirconium acetyl acetonate, zirconium sulfate, and mixtures thereof, wherein said manganese ions in the solution are from a source selected from the group consisting of manganese nitrate, manganese dihydrogen phosphate, manganese sulfate, and mixtures thereof, wherein said barium ions in the solution are from a source selected from the group consisting of barium acetate, barium nitrate, and mixtures thereof, wherein said phosphate corrosion inhibitor in the solution is from one or more compounds selected from the group consisting of sodium dihydrogen phosphate, potassium dihydrogen phosphate, ammonium dihydrogen phosphate, ammonium phosphate, sodium phosphate, potassium phosphate, and other phosphates, and wherein said solution further comprises 0.2-3 g/l molybdate as an accelerant.

2. The solution according to claim 1, wherein the molybdate is selected from the group consisting of sodium molybdate, potassium molybdate, ammonium molybdate, and mixtures thereof.

* * * * *